US005215305A

United States Patent [19]

Hsun

[11] Patent Number: 5,215,305

[45] Date of Patent: Jun. 1, 1993

[54] GAME APPARATUS

[76] Inventor: Yan-Ju Hsun, 58, Ma Yuan West St., Taichung, Taiwan

[21] Appl. No.: 884,708

[22] Filed: May 18, 1992

[51] Int. Cl.[5] ..... A63F 9/08

[52] U.S. Cl. ..... 273/153 S; 273/155

[58] Field of Search ..... 273/153 R, 153 S, 155

[56] References Cited

U.S. PATENT DOCUMENTS

| | | | |
|---|---|---|---|
| 4,416,453 | 11/1983 | Sasso | 273/155 |
| 4,540,177 | 9/1985 | Horvath | 273/153 S |
| 4,553,754 | 11/1985 | Wiggs et al. | 273/153 S |
| 4,557,484 | 12/1985 | Sherman, Jr. et al. | 273/153 S |
| 5,116,052 | 5/1992 | Pop | 273/153 S |

FOREIGN PATENT DOCUMENTS

| | | | |
|---|---|---|---|
| 1263266 | 10/1986 | U.S.S.R. | 273/153 S |

*Primary Examiner*—V. Millin
*Assistant Examiner*—Steven B. Wong

[57] ABSTRACT

A game device including a cubic body having six circular surfaces tangent with one another, a block rotatably engaged on each of the circular surfaces and each having a number of gaps formed in the peripheral edge, a shell engaged on each of the blocks and including a number of slots aligned with the gaps of the block, and a slide engaged in each of the slots. One of the slots is left blank such that the slide of one shell can be pushed into the blank when this slide is aligned with the blank.

5 Claims, 4 Drawing Sheets

GAME APPARATUS

BACKGROUND OF THE INVENTION (a) Field of the Invention

The present invention relates to a game apparatus, and more particular to a game apparatus having a spherical outer appearance.

(b) Description of the Prior Art

A typical game apparatus for children includes a cubic shape having six surfaces each having nine subpieces, such that the game apparatus includes 26 blocks formed on the outer peripheral portion. The blocks are rotatable about the axes of the game apparatus.

The present invention has arisen to provide a novel game apparatus which has a spherical shape.

SUMMARY OF THE INVENTION

The primary objective of the present invention is to provide a game apparatus which has a spherical shape.

In accordance with one aspect of the present invention, there is provided a game apparatus comprising a body including at least four circular surfaces formed in an outer peripheral portion thereof and tangent with one another, a pin engaged in each of the circular surfaces, a block engaged on each of the pins and arranged such that the blocks are rotatable about the pins respectively, each of the blocks including a curved surface having a peripheral edge, a plurality of fins formed on the peripheral edge of each of the blocks, a gap formed between every two adjacent fins, a shell engaged on each of the blocks and including a plurality of slots formed in a peripheral edge thereof and aligned with a respective gap of the blocks, the shells forming a spherical shape when the shells are engaged on the blocks, a slide slidably engaged in each of the slots; whereby, a first slide located in a first slot is movable into a second slot located in the other shell when the first slide engaged in the second slot is removed, and a second slide may be pushed into the first slot when the second slide is aligned with the first slot.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
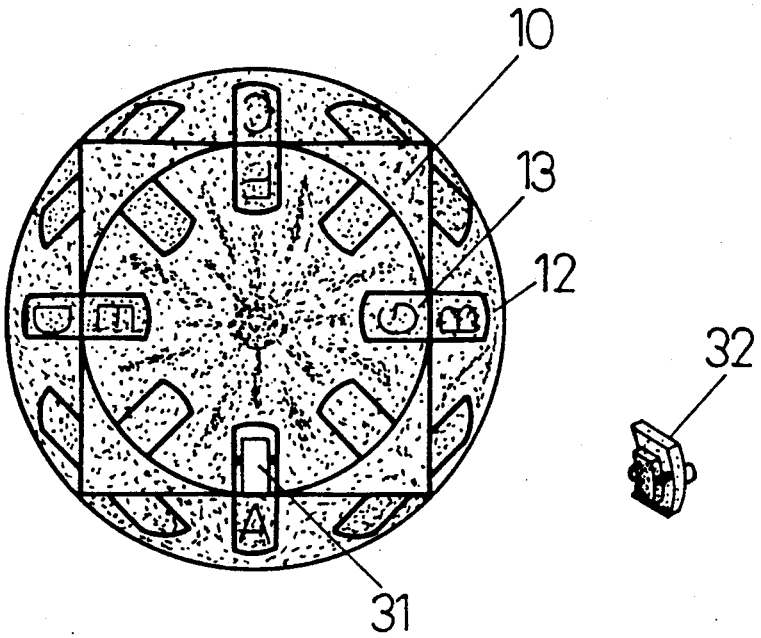
FIG. 1 is a top plane view of a game apparatus in accordance with the present invention.
Figure 2:
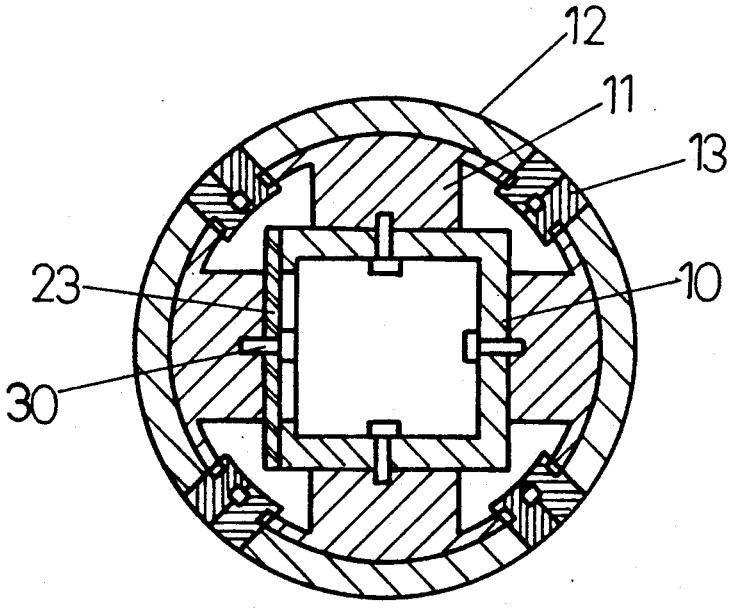
FIG. 2 is a cross sectional view taken along line 2—2 of FIG. 1.
Figure 3:
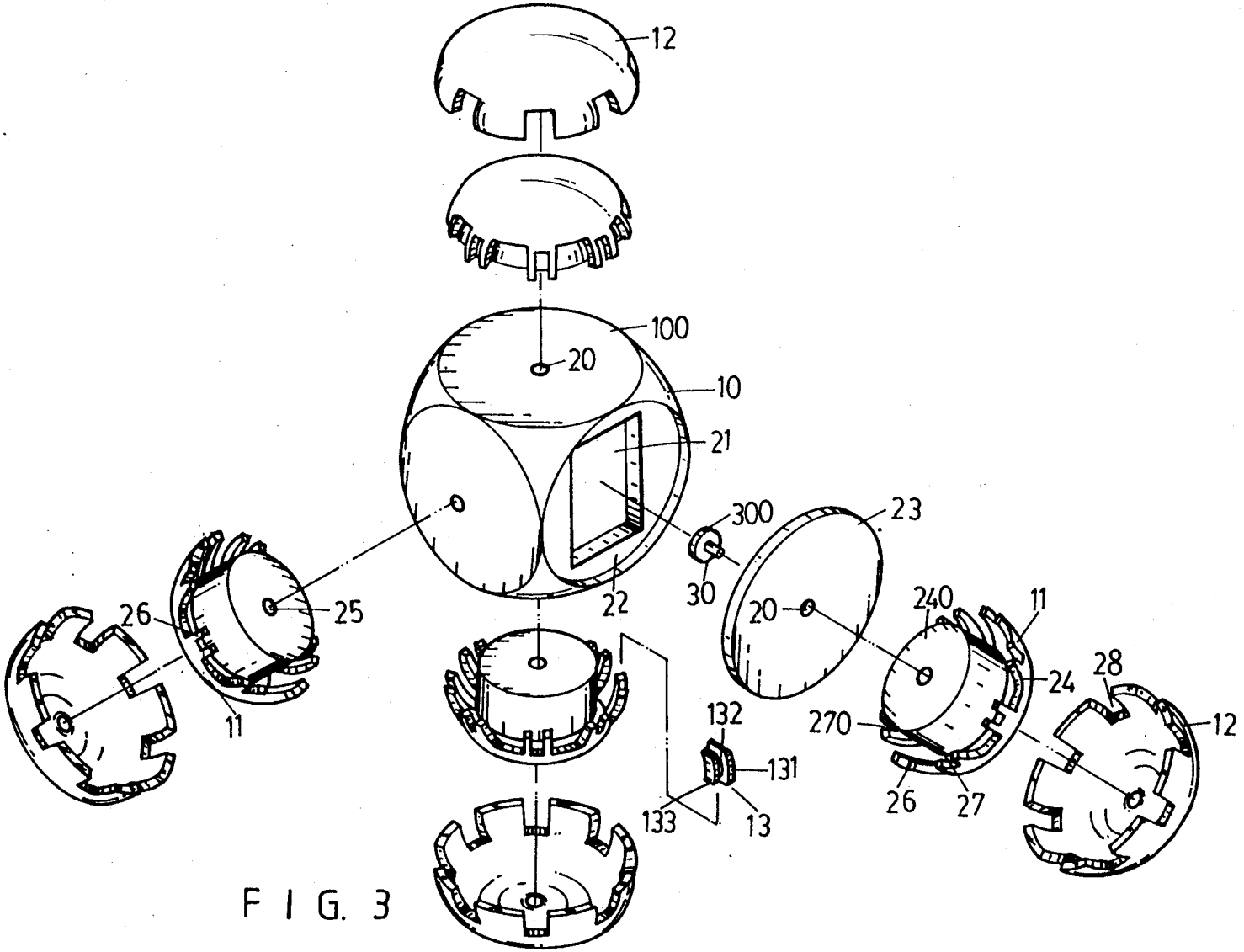
FIG. 3 is an exploded view of the game apparatus.
Figure 4:
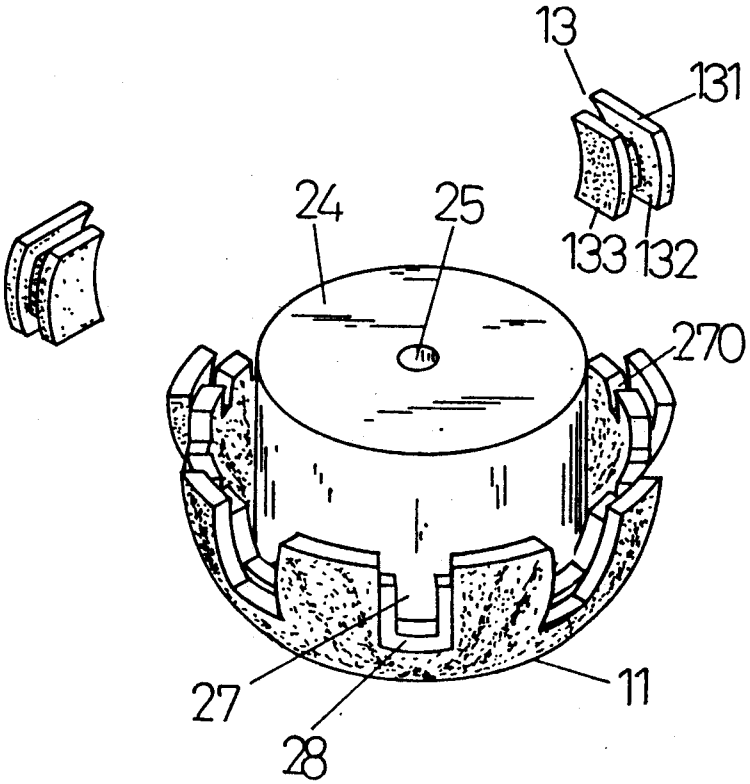
FIG. 4 is a partial exploded view of the game apparatus.

Referring to the drawings and initially to FIGS. 1 to 4, a game apparatus in accordance with the present invention comprises generally a body 10 which is substantially cubical including six circular surfaces 100 formed on the outer peripheral surface thereof, the circular surfaces 100 are tangent with one another and each has a hole 20 formed in the center thereof; in which one of the circular surfaces 100 has a depression 22 formed therein and has an opening 21 formed therein for communicating with the hollow interior of the body 10. A board 23 is engaged in the depression 22 and also has a hole 20 formed therein. A pin 30 extends outward from each of the holes 20 and includes an enlarged head 300 engaged in the interior of the body 10.

A body 11 and a shell 12 are engaged on each of the circular surfaces 100. Each of the blocks 11 includes a substantially semi-spherical or curved outer surface 24 and a flat surface 240 having a hole 25 formed therein for engagement with a respective pin 30 by such as force-fitted engagement such that the blocks 11 are rotatable about the axis of the respective pin 30. The curved surface 24 includes a peripheral edge having a plurality of fins 26 formed thereon each preferably having a notch 270 formed therein. A gap 27 is formed between every two adjacent fins 26. In the embodiment as shown in the drawings, eight fins 26 are provided, however, other number of fins, such as two, four, twelve etc. can be provided.

A shell 12 is fixed on the curved surface 24 of each of the blocks 11 and includes a plurality of slots 28 formed in the peripheral portion thereof and aligned with the respective gaps 27 of the blocks 11. The shells 12 formed a spherical shape when the shells 12 are engaged on the respective blocks 11. The size of the slot 28 is greater than that of the gap 27 such that a shoulder is formed therebetween, best shown in FIG. 4. A slide 13 is engaged in each of the slots 28 and includes three pieces 131, 132, 133 integrally formed together, in which the intermediate piece 132 is smaller than the other pieces 131, 133 and slidably engaged in each of the gaps 27, the piece 131 is slidably engaged in the respective slot 28, best shown in FIG. 2.

As shown in FIG. 1, the six shells 12 includes 48 (6 times 8) slots 28 and gaps 27 each having a slide 13 slidably engaged therein; in which, as indicated by the reference numeral "31", one of the slots and gaps is left blank and is engaged and enclosed by a cap 32 before operations.

Figure 5:
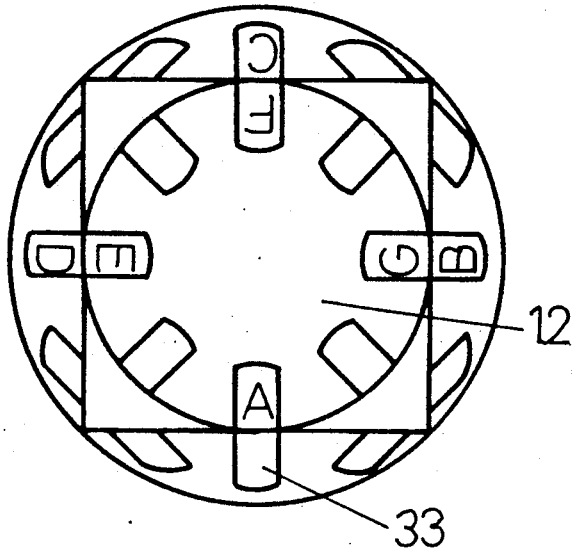
FIGS. 5 and 6 are top plane views similar to FIG. 1, illustrating the operation of the present invention.
Figure 6:
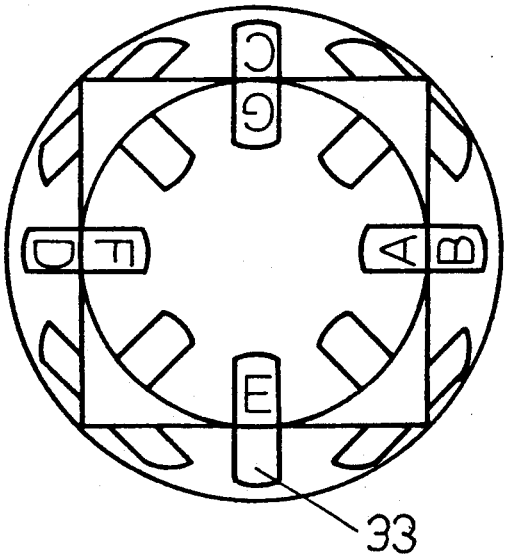

In operation, referring next to FIGS. 5 and 6, and again to FIG. 1, the cap 32 is first removed such that the blank 31 is formed. The slide 13 which is indicated by "A" can be pushed into the blank 31, and a blank 33 is formed in the place where the slide "A" is located previously, as shown in FIG. 5. When the shell 12 which carries the slides A, E. F, G is rotated, either of the slides can be aligned with the blank 33, for example, as shown in FIG. 6, the slide "E" is aligned with the blank 33, such that the slide "E" can be pushed into the blank 33.

It is to be noted that the slides carried on each of the shells 12 may have different color from that of the slides carried on the other shell 12, such that the slides of the shells 12 can be differentiated. It is further to be noted that the body 10 can be made with four, five, seven, . . . etc., circular surfaces formed in the outer peripheral portion thereof, the circular surfaces are tangent with one another.

Accordingly, the game apparatus in accordance with the present invention includes a plurality of slides whose positions can be changed.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claims.

I claim:

1. A game apparatus comprising a body including at least four circular surfaces formed in an outer peripheral portion thereof and tangent with one another, a pin engaged in each of said circular surfaces, a block engaged on each of said pins and arranged such that said blocks are rotatable about said pins respectively, each of said blocks including a curved surface having a peripheral edge, a plurality of fins formed on said peripheral edge of each of said blocks, a gap formed between every two adjacent fins, a shell engaged on each of said blocks and including a plurality of slots formed in a peripheral edge thereof and aligned with a respective gap of said block, said shells forming a spherical shape when said shells are engaged on said blocks, a slide slidably engaged in each of said slots; whereby, one of said slides located in said slot of one of said shells is movable into said slot of the other shells when said slots are aligned with each other.

2. A game apparatus according to claim 1, wherein said body includes a hollow interior, a first circular surface of said circular surfaces includes a depression formed therein and having an opening formed therein, and a board is engaged in said depression so as to form said first circular surface.

3. A game apparatus according to claim 2, wherein each of said circular surfaces includes a first hole formed in a center portion thereof, each of said pins extends through a respective first hole and includes an enlarged head engaged in said body, each of said blocks includes a second hole formed therein for engagement with said pins such that said blocks are rotatable about said pins respectively.

4. A game apparatus according to claim 1, wherein each of said fins includes a notch formed therein.

5. A game apparatus according to claim 1, wherein said gap has a size smaller than that of said slots, each of said slides includes a first piece slidably engaged in a respective slot, a second piece slidably engaged in said gap, and a third piece slidably engaged with said shell.

* * * * *